US009938947B2

(12) United States Patent
Pohlmann et al.

(10) Patent No.: US 9,938,947 B2
(45) Date of Patent: Apr. 10, 2018

(54) DECOUPLING ELEMENT FOR A FUEL INJECTION DEVICE

(71) Applicant: Robert Bosch Gmbh, Stuttgart (DE)

(72) Inventors: Jens Pohlmann, Bietigheim-Bissingen (DE); Michael Fischer, Niefern-Oeschelbronn (DE); Andreas Glaser, Stuttgart (DE); Markus Friedrich, Moosburg (DE); Martin Scheffel, Vaihingen (DE); Stefan Woerz, Vaihingen/Enz (DE); Martin Buehner, Backnang (DE); Thomas Gerschwitz, Eberdingen (DE); Anh-Tuan Hoang, Plymouth, MI (US)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 14/367,698

(22) PCT Filed: Nov. 9, 2012

(86) PCT No.: PCT/EP2012/072317
§ 371 (c)(1),
(2) Date: Jun. 20, 2014

(87) PCT Pub. No.: WO2013/091998
PCT Pub. Date: Jun. 27, 2013

(65) Prior Publication Data

US 2015/0316014 A1 Nov. 5, 2015

(30) Foreign Application Priority Data

Dec. 20, 2011 (DE) ..... 10 2011 089 274

(51) Int. Cl.
*F02M 61/14* (2006.01)

(52) U.S. Cl.
CPC ..... *F02M 61/14* (2013.01); *F02M 2200/09* (2013.01); *F02M 2200/26* (2013.01); *F02M 2200/858* (2013.01)

(58) Field of Classification Search
CPC ..... F02M 2200/858; F02M 2200/09; F02M 61/14; F02M 61/16; F02M 61/167; F02F 11/002; F16J 15/06
(Continued)

(56) References Cited

U.S. PATENT DOCUMENTS 3,214,182 A * 10/1965 Herbruggen ..... F16J 15/32 277/465
6,009,856 A 1/2000 Smith, III et al.
(Continued)

FOREIGN PATENT DOCUMENTS

CN 101012797 A 8/2007
CN 101784787 A 7/2010
(Continued)

OTHER PUBLICATIONS

"Stiffness." Stiffness. Wikipedia, Nov. 30, 2010. Web. Oct. 26, 2015. <20101130023311/http://en.wikipedia.org/wiki/Stiffness>.*
(Continued)

*Primary Examiner* — Jacob Amick
*Assistant Examiner* — Michael A Kessler
(74) *Attorney, Agent, or Firm* — Norton Rose Fulbright US LLP; Gerard Messina

(57) ABSTRACT

A decoupling element is described for a fuel injection device which is characterized in particular by a low-noise design. The fuel injection device includes at least one fuel injector, a receiving bore in a cylinder head for the fuel injector, and the decoupling element between a valve housing of the fuel injector and a wall of the receiving bore. The decoupling element is designed as a decoupling system having a spring
(Continued)

ring and a conical washer. The fuel injection device is suitable for injecting fuel into a combustion chamber of a mixture-compressing spark-ignition internal combustion engine in particular.

26 Claims, 6 Drawing Sheets

(58) Field of Classification Search
USPC ..... 123/470; 277/594, 597, 626
See application file for complete search history.

(56) References Cited

U.S. PATENT DOCUMENTS

| | | | | |
|---|---|---|---|---|
| 6,325,049 | B1 * | 12/2001 | Nally | F02M 61/145 123/470 |
| 6,651,628 | B2 * | 11/2003 | Nally | F02M 61/145 123/470 |
| 6,807,945 | B2 * | 10/2004 | Reiter | F02M 61/14 123/470 |
| 7,293,550 | B2 * | 11/2007 | Beardmore | F02M 61/14 123/470 |
| 7,827,964 | B2 * | 11/2010 | Chern | F02M 61/14 123/470 |
| 2010/0175668 | A1 | 7/2010 | Chern et al. | |

FOREIGN PATENT DOCUMENTS

| | | | | |
|---|---|---|---|---|
| DE | 10027662 | | 12/2001 | |
| DE | 10038763 | | 2/2002 | |
| DE | 10108466 | | 9/2002 | |
| DE | 102005057313 | A1 * | 6/2007 | F02M 61/14 |
| DE | 102008002654 | | 12/2009 | |
| EP | 1223337 | | 7/2002 | |
| JP | 2003003931 | A | 1/2003 | |
| JP | 2004506136 | A | 2/2004 | |
| JP | 2004518853 | A | 6/2004 | |
| JP | 2008202503 | | 9/2008 | |
| JP | 2011525585 | A | 9/2011 | |
| WO | WO 2007054499 | A1 * | 5/2007 | F02M 61/14 |
| WO | WO 2010082991 | A1 * | 7/2010 | F02M 61/14 |
| WO | WO 2011008369 | A1 * | 1/2011 | F16F 1/328 |

OTHER PUBLICATIONS

"Cross Section." Cross Section. Math Captain.com, Sep. 25, 2013. Web. Oct. 26, 2015. <http://www.mathcaptain.com/geometry/cross-section.html>.*

English machine translation provided by Espacenet for WO 2007054499 A1.*

English machine translation provided by Espacenet for DE 102005057313 A1.*

International Search Report for PCT/EP2012/072317, dated Mar. 25, 2013.

* cited by examiner

DECOUPLING ELEMENT FOR A FUEL INJECTION DEVICE

FIELD OF THE INVENTION

The present invention is directed to a decoupling element for a fuel injection device.

BACKGROUND INFORMATION

FIG. 1 shows as an example a fuel injection device which is known from the related art and in which a flat intermediate element is provided on a fuel injector installed in a receiving bore in a cylinder head of an internal combustion engine. Such intermediate elements as supporting elements in the form of a washer are placed on a shoulder of the receiving bore of the cylinder head in a known way. With the aid of such intermediate elements, manufacturing tolerances and assembly tolerances are compensated and a bearing support free of transverse forces is ensured even when the fuel injector is in a slightly skewed position. The fuel injection device is suitable for use in fuel injection systems in mixture-compressing, spark-ignition internal combustion engines in particular.

Another type of simple intermediate element for a fuel injection device is already known from German Published Patent Appln. No. 101 08 466. This intermediate element is a washer having a circular cross section and is situated in an area where both the fuel injector and the wall of the receiving bore have a truncated conical shape in the cylinder head, and the washer acts as an equalizing element for support of the fuel injector.

More complex intermediate elements for fuel injection devices, which are definitely more complicated to manufacture, are known from German Published Patent Appln. No. 100 27 662; German Published Patent Appln. No. 100 38 763; and European Published Patent Appln. No. 1 223 337, among others. These intermediate elements are characterized in that they are all constructed in multiple layers or multiple parts and should undertake sealing and damping functions to some extent. The intermediate element known from German Published Patent Appln. No. 100 27 662 has a base body and a carrier body, in which a sealant through which a nozzle body of the fuel injector passes is used. German Published Patent Appln. No. 100 38 763 describes a multilayer equalizing element made up of two rigid rings and an elastic intermediate ring sandwiched in between. This equalizing element permits tilting of the fuel injector relative to the axis of the receiving bore over a relatively large angle range as well as radial displacement of the fuel injector from the central axis of the receiving bore.

European Published Patent Appln. No. 1 223 337 also describes a multilayer intermediate element composed of multiple washers, each made of a damping material. The damping material made of metal, rubber or PTFE is selected and designed in such a way that it enables damping of the vibrations and noises generated by operation of the fuel injector. However, the intermediate element must have four to six layers to achieve the sought damping effect.

To reduce noise emissions, U.S. Pat. No. 6,009,856 also proposes to surround the fuel injector using a sleeve and to fill the created gap with an elastic noise-absorbing material. However, this type of noise damping is very complex, difficult to install and expensive.

SUMMARY

The decoupling element according to the present invention for a fuel injection device has the advantage that it is designed with a very simple structure and thus improved noise damping is achieved. According to the present invention, the decoupling element has a nonlinear progressive spring characteristic, which results in several positive and advantageous aspects when the decoupling element is installed in a fuel injection device having injectors for direct fuel injection. The low stiffness of the decoupling element at the idling point permits effective decoupling of the fuel injector from the cylinder head and thereby significantly reduces the noise emanating from the cylinder head in the noise-critical idling mode. The great stiffness at a nominal system pressure ensures little movement of the fuel injector on the whole during operation of the vehicle, which thereby, on the one hand, ensures the durability of the sealing rings which function as a combustion chamber seal and as a seal with respect to the fuel rail and, on the other hand, a stable spray point of the fuel spray in the combustion chamber, which is decisive for the stability of some combustion methods.

The spring characteristic of the decoupling element according to the present invention may advantageously be designed to be progressive in a targeted manner by adjusting the geometric parameters of the spring ring in particular. The decoupling element is characterized by a small design height, so that it may also be used even in a very small installation space similar to a plate spring. The decoupling element also has a great durability even at high temperatures. The spring ring and the conical washer are two components for the decoupling element which are manufacturable very easily in terms of manufacturing technology.

The nonlinear spring characteristic may also be adjusted specifically to the particular application due to the geometry of the spring ring. The stiffness may also be modified by modifying the cone angle of the conical washer, so that the contact area with the spring ring may be modified.

It is advantageous in particular that the conical washer is to be provided with a hexagonal cross section in such a way that there are two longer bordering sides and four shorter bordering sides of the conical washer. On the one hand, the spring ring may thus be supported on one of the two longer bordering sides of the conical washer, while on the other hand, the conical washer rests on the shoulder of the receiving bore for the fuel injector along one of the four shorter bordering sides.

DETAILED DESCRIPTION

Figure 1:
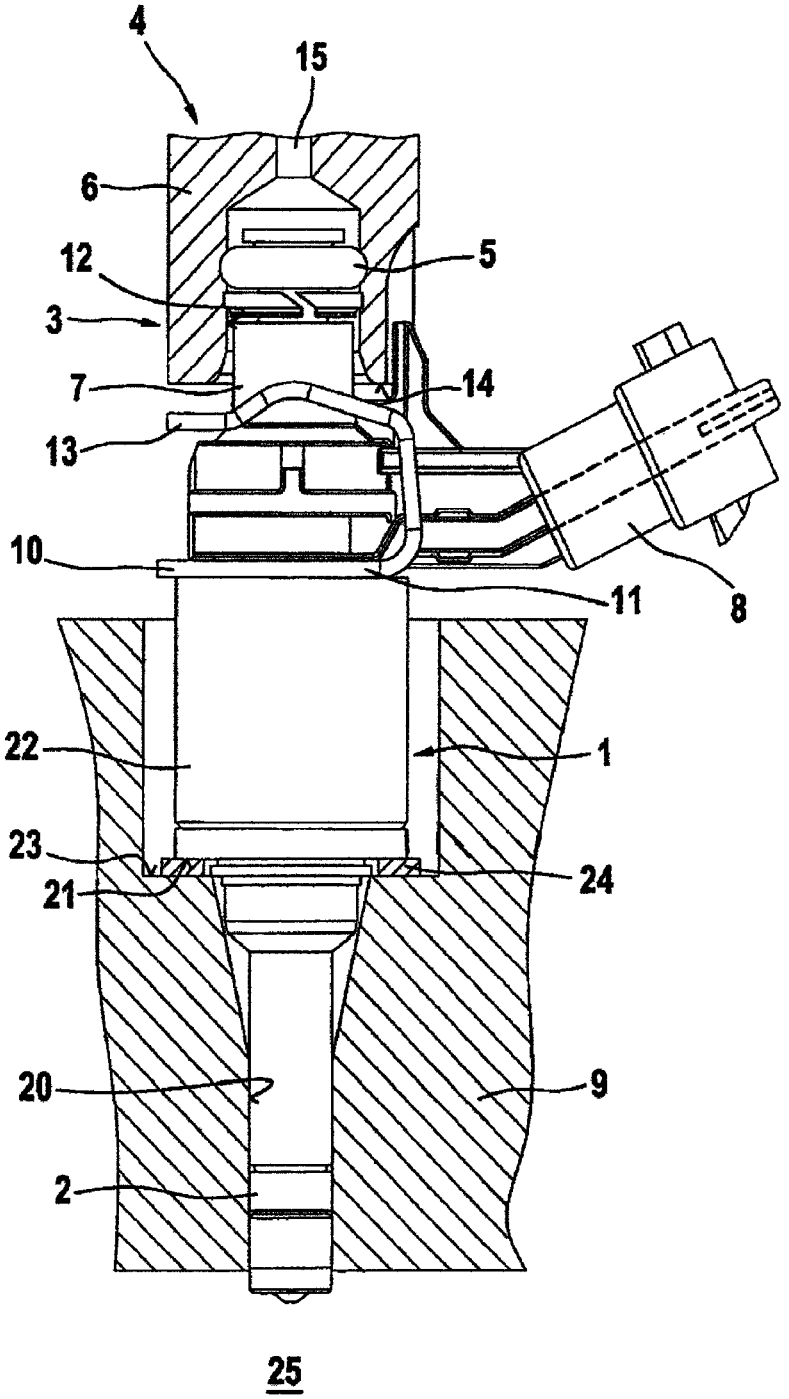
FIG. 1 shows a partial illustration of a fuel injection device in a known embodiment having a disk-shaped intermediate element.

For an understanding of the present invention, a known specific embodiment of a fuel injection device is described in greater detail below on the basis of FIG. 1. As one exemplary embodiment, FIG. 1 shows a side view of a valve in the form of an injector 1 for fuel injection systems of mixture-compressing spark ignition internal combustion engines. Fuel injector 1 is part of the fuel injection device. Fuel injector 1 is designed in the form of a direct-injecting injector for direct injection of fuel into a combustion chamber 25 of the internal combustion engine and is installed at its downstream end in a receiving bore 20 of a cylinder head 9. A sealing ring 2 made of Teflon® in particular ensures an optimal seal of fuel injector 1 with respect to the wall of receiving bore 20 of cylinder head 9.

A flat intermediate element 24, designed as a supporting element in the form of a washer, is inserted between a surface 21 of a valve housing 22 and a shoulder 23 of receiving bore 20 running at a right angle to the longitudinal extent of receiving bore 20, for example. Manufacturing and assembly tolerances are compensated with the aid of such an intermediate element 24, and a support which is free of transverse forces is ensured even when the position of fuel injector 1 is slightly skewed.

On its inlet end 3, fuel injector 1 has a plug connection to a fuel distributor line (fuel rail) 4, which is sealed by a sealing ring 5 between a connecting piece 6 of fuel distributor line 4, which is shown in a sectional view, and an inlet connection 7 of fuel injector 1. Fuel injector 1 is inserted into a receiving opening 12 in connecting piece 6 of fuel distributor line 4. Connecting piece 6 emerges in one piece from the actual fuel distributor line 4, for example, and has a flow opening 15, which has a smaller diameter, upstream from receiving opening 12, through which the oncoming flow of fuel injector 1 is directed. Fuel injector 1 has an electrical connecting plug 8 for electrical contacting for actuation of fuel injector 1.

To keep fuel injector 1 and fuel distributor line 4 apart from one another, so they are largely free of radial forces, and to securely hold down fuel injector 1 in the receiving bore of the cylinder head, a hold-down device 10 is provided between fuel injector 1 and connecting piece 6. Hold-down device 10 is designed as a bow-shaped component, for example, as a punched and bent part. Hold-down device 10 has a partially ring-shaped basic element 11 from which a hold-down clamp 13 with a bend comes into contact with a downstream end face 14 of connecting piece 6 at fuel distributor line 4 in the installed state.

The object of the present invention is to achieve improved noise damping, in particular in the noise-critical idling mode, in a simple manner in comparison with the known intermediate element approaches by using a targeted design and geometry of intermediate element 24. The forces (structure-borne noise) which are introduced into cylinder head 9 during valve operation and result in a structural excitation of cylinder head 9 and are emitted by same as airborne noise are the critical source of noise from fuel injector 1 in direct high-pressure injection. Therefore, to improve the noise situation, the goal is to minimize the forces introduced into cylinder head 9. In addition to reducing the forces due to the injection, this may be achieved by influencing the transmission behavior between fuel injector 1 and cylinder head 9.

Figure 2:
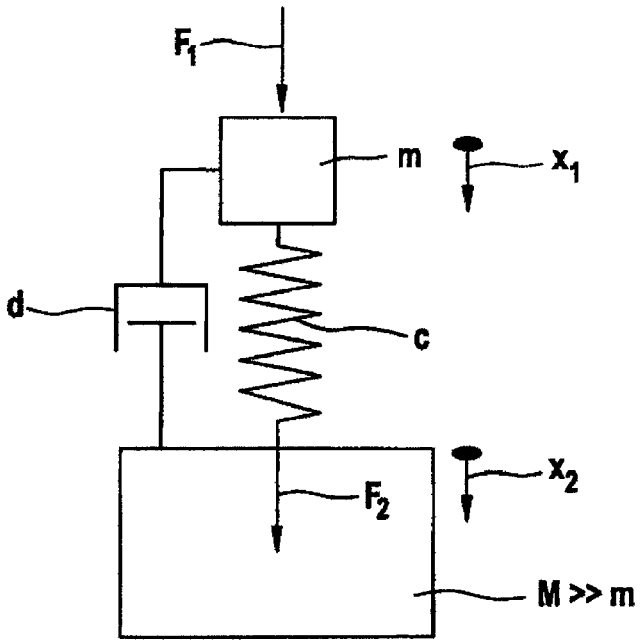
FIG. 2 shows a mechanical equivalent diagram of the support of the fuel injector in the cylinder head in direct fuel injection, representing an ordinary spring-mass-damper system.
Figure 3:
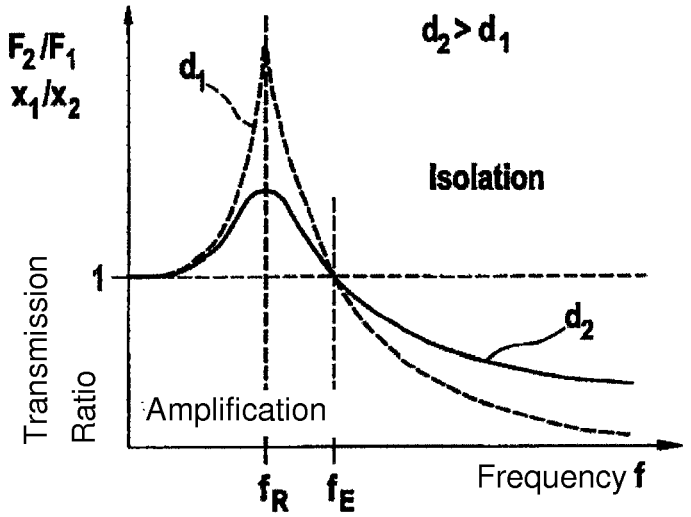
FIG. 3 shows the transmission behavior of a spring-mass-damper system as shown in FIG. 2, having an amplification at low frequencies in the range of resonant frequency $f_R$ and an insulation area above decoupling frequency $f_E$.

In a mechanical sense, the support of fuel injector 1 on passive intermediate element 24 in receiving bore 20 of cylinder head 9 may be thought of as an ordinary spring-mass-damper system, as illustrated in FIG. 2. Mass M of cylinder head 9 may be assumed in first approximation to be infinitely large in comparison with mass m of fuel injector 1. The transmission behavior of such a system is characterized by an amplification at low frequencies in the range of resonant frequency $f_R$ and an isolation range above decoupling frequency $f_E$ (see FIG. 3).

The goal of the present invention is to design an intermediate element 24 with priority use of elastic isolation (decoupling) for noise reduction, in particular in idling mode of the vehicle. The present invention relates to the definition and design of a suitable spring characteristic, on the one hand, taking into account the typical requirements and boundary conditions in direct injection of fuel at a variable operating pressure, and on the other hand, the design of an intermediate element 24, which is capable of mapping the characteristic of the spring characteristic thus defined and which may be adapted to the specific boundary conditions of the injection system through a choice of simple geometric parameters.

Figure 4:
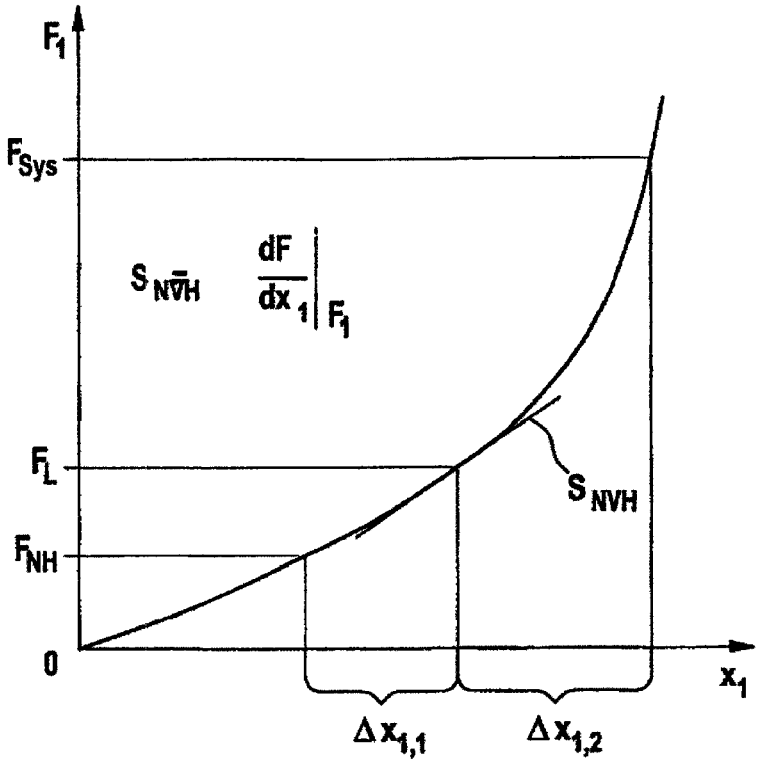
FIG. 4 shows a nonlinear progressive spring characteristic for implementation of different stiffness values as a function of the operating point, having a low stiffness $S_{NVH}$ in idling mode and a high stiffness at nominal system pressure $F_{Sys}$.

Decoupling of fuel injector 1 from cylinder head 9 with the aid of a low spring stiffness c of the decoupling system according to the present invention formed by a spring ring 30 and a conical washer 31 is made difficult by a restriction on the allowed maximum movement of fuel injector 1 during engine operation in addition to the small installation space. As shown in FIG. 4, the following quasi-static load states typically occur in the vehicle:

1. static hold-down force $F_{NH}$ applied by a hold-down device 10 after assembly,
2. force $F_L$ which prevails at an idling mode pressure and
3. force $F_{Sys}$ which prevails at a nominal system pressure.

Ordinary supporting elements as intermediate elements 24 have a linear spring characteristic in the force range indicated. As a result, the stiffness of intermediate element 24 at the sought decoupling point during idling mode is based on the maximum allowed movement of fuel injector 1, as defined above, and is too large for effective decoupling. This problem will be further exacerbated since the nominal operating pressures will presumably increase further in the future.

To solve this conflict, according to the present invention, a nonlinear spring characteristic having a progressive curve is proposed for decoupling system 30, 31 (FIG. 5), as diagrammed in FIG. 4. The characteristic of this spring characteristic permits noise decoupling with the aid of a low spring stiffness ($S_{NVH}$) during idling mode and makes it possible to maintain the maximum movement of fuel injector 1 between idle pressure and system pressure due to the rapid increase in stiffness.

To be able to implement the nonlinear spring characteristic easily and inexpensively under the typical boundary conditions of direct fuel injection (small installation space, extremely high forces, minor total movement of fuel injector 1), the decoupling system is constructed according to the present invention from a spring ring 30 and a conical washer 31, spring ring 30 in particular creating a distinctly progressive spring characteristic because of its particular geometric design. It thus differs distinctly from traditional plate springs, which fundamentally have initially only a linear or degressive characteristic. With traditional plate springs, a progressive characteristic is achieved only when its load is almost completely "blocked."

Figure 5:
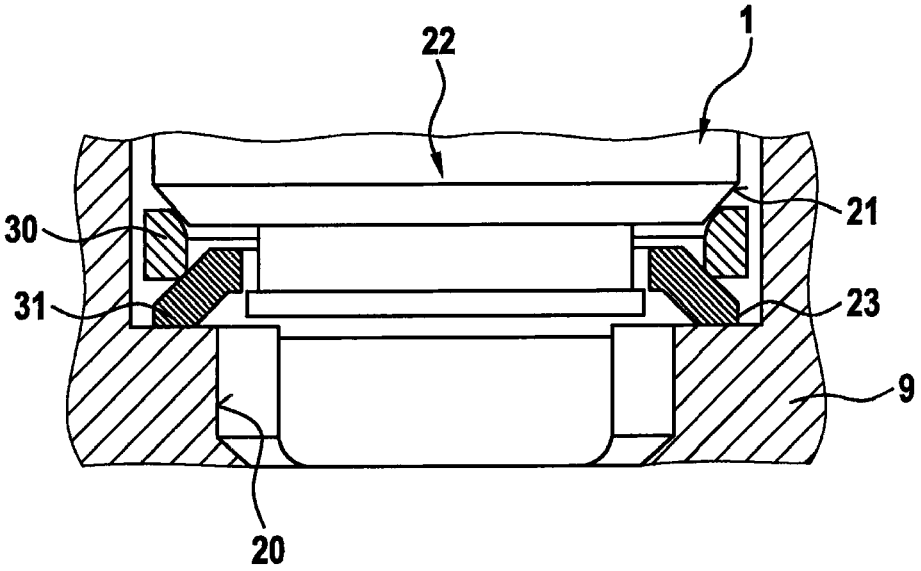
FIG. 5 shows a cross section through a decoupling element according to the present invention in an installed situation on a fuel injector in the area of the disk-shaped intermediate element shown in FIG. 1.
Figure 6:
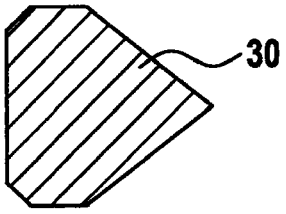
FIGS. 6 through 9 show cross sections through alternative embodiments of spring rings.
Figure 7:
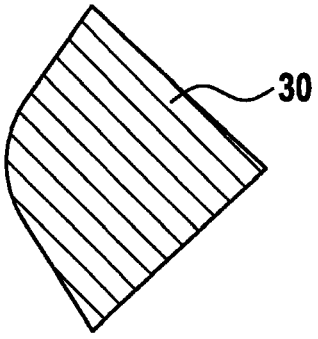
Figure 8:
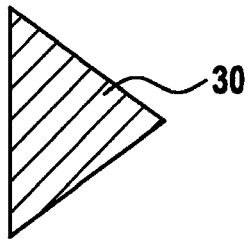
Figure 10:
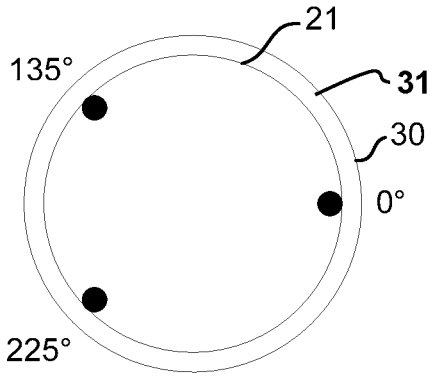
FIG. 10 is a schematic representation of a three-point contact of a spring ring with a surface of a valve housing and/or with a washer, according to an example embodiment of the present invention.

FIG. 5 shows a cross section through a decoupling system according to the present invention in an installed situation on a fuel injector 1 in the area of disk-shaped intermediate element 24 shown in FIG. 1, intermediate element 24 being replaced by the unit of spring ring 30 and conical washer 31 according to the present invention. The mechanism on which spring ring 30 is based, having a nonlinear progressive spring characteristic, is induced intentionally on spring ring 30 by a distinct ring shape in a targeted manner. The progressivity of spring ring 30 is easily designed by adjusting a few geometric parameters. The contour of spring ring 30 is characterized in that, starting from an outer planar perpendicular lateral surface, a rounded curved convex internal contour follows. To this extent, spring ring 30 has a cross section resembling a semicircle, in which the rounded border is directed inward. The cross section of spring ring 30 may also be somewhat triangular in shape, with sections having radii or a circular design preferably also being provided here. With its molded contouring on the inside having at least spherical ring areas, spring ring 30 in the installed state of the decoupling system corresponds to a conical valve housing surface 21. The design of spring ring 30 is selected in such a way that it ideally comes to a three-point contact of spring ring 30 with valve housing 22 of fuel injector 1 and/r with conical washer 31. The three contact points may be spaced apart by approximately 135°-90°-135°, as schematically shown in FIG. 10, but they may also be distributed uniformly. Thus a solid-state joint permitting an equalization of tolerance to prevent a geometric match is also integrated into the design of the decoupling system in some respects.

The decoupling system is supplemented by conical washer 31 in addition to spring ring 30. Conical washer 31 has a hexagonal cross section, although the hexagonal cross section is elongated rather than being a uniform honeycomb design, so that the cross section has two longer bordering sides and four shorter bordering sides of conical washer 31, running completely around the circumference on the whole. Spring ring 30 is supported on the side facing away from valve housing surface 21, the side being at least partially rounded and having a convex internal contour on one of the two longer bordering sides of conical washer 31, whereas conical washer 31 is in contact with one of the four shorter bordering sides on receiving bore 20. Receiving bore 20 of cylinder head 9 in this case has a shoulder 23 running at a right angle to the total extent of receiving bore 20. As shown in FIG. 5, conical washer 31 may be inserted with its conical taper facing upward, but installation of conical washer 31 with its conical taper facing downward is also conceivable. Conical washer 31 may of course also have a triangular or pentagonal cross section instead of the hexagonal cross section.

Figure 9:
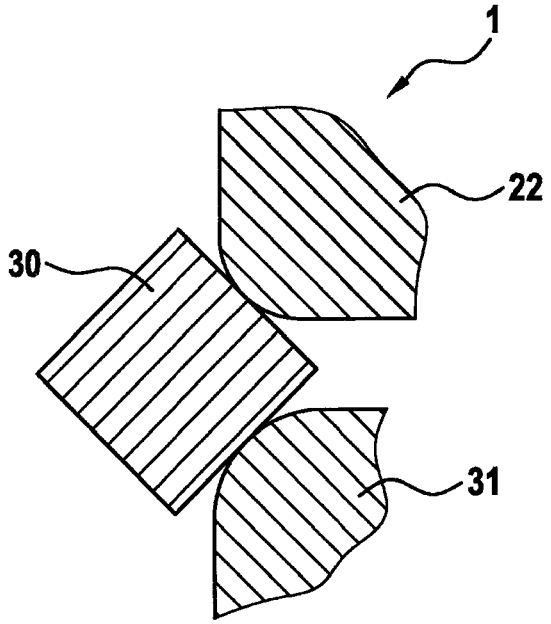

FIGS. 6 through 9 show four different cross sections through alternative embodiments of spring rings 30. Spring ring 30 may thus have a triangular cross section, for example, having additional upper and lower flattened surfaces (FIG. 6), triangular with a lateral surface having a convex curvature on the outside (FIG. 7), triangular (FIG. 8) or a parallelogram in the form of a diamond (FIG. 9) or the like. FIG. 9 also schematically shows that in one design of spring ring 30 having largely planar bordering surfaces which function as contact surfaces, valve housing 22 of fuel injector 1 and conical washer 31 were designed with a convex curvature, i.e., rounding on their corresponding outer contours, again in order to create the small-area contact points described above.

The nonlinear progressive spring characteristic of the decoupling system according to the present invention is implemented by a shortening of the level arm by reducing the free arc length with increasing load on the decoupling system. A smaller lever arm produces a greater stiffness of the decoupling system. The shortening of the lever arm is achieved by making spring ring 30 conform to the corresponding two contact partners, i.e., valve housing 22 with its valve housing surface 21 and conical washer 31. The nonlinear spring characteristic may be adapted specifically to the particular application through the geometry of spring ring 30. The stiffness may optionally also be modified by modifying the cone angle of conical washer 31, so that the contact surface with spring ring 30 may be altered.

What is claimed is:

1. A decoupling element for a fuel injection device for a fuel injection system of an internal combustion engine, the fuel injection device including at least one fuel injector and a receiving bore for the fuel injector, comprising:

a structure introduced between a valve housing of the fuel injector and a wall of the receiving bore, the structure of the decoupling element including a decoupling system that includes:

(a) a spring ring, wherein:

an upper portion of the spring ring is a seat (i) against which a portion of the housing is configured to be seated and (ii) that is non-parallel to, and at a non-perpendicular angle to, a central longitudinal axis of the receiving bore; and the spring ring defines an interior space surrounded by an inner wall of the spring ring; and (b) a conical washer, wherein:

the conical washer is partially positioned below the spring ring and extends upward from below the spring ring into the interior space so that:

a first portion of the conical washer is (i) at a lower position than a lowest point of the spring ring, (ii) not within the inner wall of the spring ring, and (iii) not circumferentially surrounded by the inner wall of the spring ring; and a second portion of the conical washer is within and circumferentially surrounded by the inner wall of the spring ring;

an interior surface of the conical washer tapers radially outward from (i) a first axial position that is occupied by the second portion of the conical washer and at which the interior surface forms a first interior circumferential edge of a first diameter to (ii) a second axial position occupied by the first portion of the conical washer that is lower than the first axial position and at which the conical washer forms a second interior circumferential edge of a second diameter that is larger than the first diameter, the interior surface thereby forming a conical interior hollow space between the first and second axial positions; and an exterior surface of the conical washer tapers radially outward from the first axial position to the second axial position with a bottom edge of the spring ring contacting the tapered exterior surface of the conical washer at a contact point between the first and second axial positions.

2. The decoupling element as recited in claim 1, wherein the decoupling element is for a direct injection of a fuel into a combustion chamber.

3. The decoupling element as recited in claim 1, wherein the spring ring is installable toward the fuel injector, and the conical washer is installable toward the receiving bore.

4. The decoupling element as recited in claim 1, wherein the spring ring has an at least partially rounded, convex internal contour that curves from an outer planar lateral surface perpendicular to the central longitudinal axis.

5. The decoupling element as recited in claim 4, wherein the inner wall of the spring ring is shaped to include an edge that circumferentially extends about a center axis of the spring ring and to taper outward radially away from the edge and away from the center axis both upwards and downwards, thereby defining a first inner radial surface extending upwards away from the radial edge and away from the center axis and a second inner radial surface extending downwards away from the radial edge and away from the center axis.

6. The decoupling element as recited in claim 1, wherein the spring ring has one of a triangle-like cross section and a quadrangle-like cross section having planar contact surfaces.

7. The decoupling element as recited in claim 1, wherein the spring ring is shaped in such a way that, with respect to a circumferential direction about the fuel injector, at least one of the following:

the spring ring makes contact with the fuel injector only at a subset of circumferential positions that are each separated from all others of the subset by a respective number of degrees, the spring ring not contacting the fuel injector at any other circumferential position about the fuel injector other than the subset; and the spring ring makes contact with the conical washer only at a subset of circumferential positions that are each separated from all others of the subset by a respective number of degrees, the spring ring not contacting the conical washer at any other circumferential position about the fuel injector other than the subset.

8. The decoupling element as recited in claim 1, wherein the conical washer has a hexagonal cross section.

9. The decoupling element as recited in claim 8, wherein the conical washer has two longer and four shorter bordering sides, as seen in cross section.

10. The decoupling element as recited in claim 8, wherein the conical washer is insertable with its conical taper facing one of upward and downward.

11. The decoupling element as recited in claim 9, wherein, on an at least partially rounded curved convex internal contour of the spring ring, the spring ring is supported on one of the two longer bordering sides of the conical washer.

12. The decoupling element as recited in claim 9, wherein:

the receiving bore for the fuel injector is formed in a cylinder head, and the receiving bore has a shoulder that runs at a right angle to an extent of the receiving bore and on which the conical washer rests.

13. The decoupling element as recited in claim 1, wherein the spring ring has a curved cross-section.

14. The decoupling element as recited in claim 4, wherein the spring ring has a triangle-like cross section that has radii.

15. The fuel injection device as recited in claim 7, wherein the subset of circumferential positions consists of exactly three circumferential positions.

16. The fuel injection device as recited in claim 15, wherein (a) a first pair of adjacent ones of the subset of the circumferential positions are separated by 135°, (b) a second pair of adjacent ones of the subset of the circumferential positions are separated by 135°, and (c) a third pair of adjacent ones of the subset of the circumferential positions are separated by 90°.

17. The decoupling element as recited in claim 1, wherein the conical washer has a hexagonal cross section, composed of two long exterior walls of the conical washer and four shorter exterior walls of the conical washer, that runs completely about the fuel injector.

18. A fuel injection device for an internal combustion engine, the fuel injection device comprising:

a fuel injector that includes a valve housing; and a decoupling element that (a) is arranged between the valve housing and a wall of a receiving bore in which the fuel injector is inserted, and (b) includes:

a spring ring, wherein an upper portion of the spring ring is a seat against which a portion of the housing is configured to be seated; and a conical washer that contacts, and is at least partially positioned below, the spring ring and, wherein at every point completely about the fuel injector, an exterior of the conical washer forms in cross section a hexagon comprised of two long and four shorter walls.

19. The fuel injection device as recited in claim 18, wherein the spring ring is installable toward the fuel injector, and the conical washer is installable toward the receiving bore.

20. The fuel injection device as recited in claim 18, wherein the spring ring has an at least partially rounded, convex internal contour that curves from an outer planar lateral surface perpendicular to a central longitudinal axis of the receiving bore.

21. The fuel injection device as recited in claim 20, wherein an inner wall of the spring ring is shaped to include an edge circumferentially extending about a center axis of the spring ring and to taper outward radially away from the edge and away from the center axis both upwards and downwards, thereby defining a first inner radial surface extending upwards away from the edge and away from the center axis and a second inner surface extending downwards away from the edge and away from the center axis.

22. The fuel injection device as recited in claim 18, wherein the spring ring has one of a triangle-like cross section and a quadrangle-like cross section having planar contact surfaces.

23. The fuel injection device as recited in claim 18, wherein, on an at least partially rounded curved convex internal contour of the spring ring, the spring ring is supported on one of the two longer bordering sides of the conical washer.

24. The fuel injection device as recited in claim 18, wherein the receiving bore is formed in a cylinder head and has a shoulder that runs at a right angle to an extent of the receiving bore and on which the conical washer rests.

25. The fuel injection device as recited in claim 18, wherein the conical washer is insertable with its conical taper facing one of upward and downward.

26. The decoupling element as recited in claim 18, wherein a portion of the conical washer is at lower position than a lowest point of the spring ring so that:

the portion of the conical washer is not within an inner wall of the spring ring; and the portion of the conical washer is not circumferentially surrounded by the inner wall of the spring ring.

* * * * *